US005477816A

United States Patent [19]

Ranzinger et al.

[11] Patent Number: 5,477,816

[45] Date of Patent: Dec. 26, 1995

[54] COOLING APPARATUS FOR A MOTOR VEHICLE LIQUID-COOLED INTERNAL COMBUSTION ENGINE

[75] Inventors: Guenter Ranzinger, Garching; Gerhart Huemer, Neukeferloh; Joachim Froeschl, Herrsching; Hans Hohenner, Munich, all of Germany

[73] Assignee: Bayerische Motoren Werke Aktiengesellschaft, Germany

[21] Appl. No.: 309,468

[22] Filed: Sep. 22, 1994

[30] Foreign Application Priority Data

Sep. 22, 1993 [DE] Germany ..... 43 32 101.1

[51] Int. Cl.[6] ..... F01P 7/14

[52] U.S. Cl. ..... 123/41.1

[58] Field of Search ..... 123/41.01; 236/34.5

[56] References Cited

U.S. PATENT DOCUMENTS 4,875,437 10/1989 Cook et al. ..... 123/41.1

FOREIGN PATENT DOCUMENTS

| | | |
|---|---|---|
| 0184196 | 6/1986 | European Pat. Off. . |
| 419037 | 5/1924 | Germany . |
| 3018682 | 11/1988 | Germany . |
| 4035179 | 5/1992 | Germany . |
| 4022731 | 6/1992 | Germany . |
| 4042404 | 11/1992 | Germany . |

*Primary Examiner*—Noah P. Kamen

*Attorney, Agent, or Firm*—Evenson, McKeown, Edwards & Lenahan

[57] ABSTRACT

A cooling device is provided for a motor vehicle liquid-cooled internal combustion engine with a radiator connected to the supply and return lines of the engine. The radiator has a filling opening closable by a cap. A temperature-controlled thermostatic valve, via which the coolant is sent completely or partially either through the radiator or through a bypass between the supply and return lines to bypass the radiator, is controllable by electrical heating. An electrical switch is mounted on the filling opening such that upon actuation the thermostatic valve is electrically heated, so that the coolant passes at least partially through the radiator.

3 Claims, 2 Drawing Sheets

COOLING APPARATUS FOR A MOTOR VEHICLE LIQUID-COOLED INTERNAL COMBUSTION ENGINE

BACKGROUND AND SUMMARY OF THE INVENTION

The present invention relates to a cooling device for a motor vehicle liquid-cooled internal combustion engine with a radiator connected to the supply and return lines of the engine, and more particularly, to a cooling device in which the radiator has a filling opening closable by a cap, and a temperature-controlled thermostatic valve by which the coolant is sent completely or partially through a radiator or through a bypass.

A cooling device is shown in EP 0 184 196 B1 and also contains a bypass return line from an expansion tank provided with a filling opening, bypassing a thermostat, to the connection of a return line to the engine. To fill the cooling system with coolant during the initial filling or when refilling, the coolant is added through the filling opening and distributes itself through the bypass return line in the engine, bypassing the thermostat. The coolant flows from the engine through the supply line into the radiator. Since the line cross sections are designed in accordance with requirements during operation of the cooling system, the filling process is time-consuming because, as a rule, the bypass return line has a smaller diameter than the supply and return lines. At the same time, the temperature-controlled thermostatic valve sends the cold coolant through the bypass between the supply and return lines, and not through the radiator.

To ensure that no significant air pockets remain in the cooling system after filling, the engine is operated in idle for a time, with the filling opening in the open position. Due to improvements in fuel consumption and emissions, the modern engine cooling system operates at higher than ambient pressure, because the coolant then starts to boil at a higher temperature. The opening temperature of the thermostat is designed accordingly. If the engine is operated with the cooling system open after filling, the temperature-controlled thermostat either does not respond or responds only very slightly when the boiling point of the coolant at ambient pressure is reached. Therefore, when filling the radiator with the engine idling and with the filling opening open, the engine can overheat because the temperature is too low and the thermostatic valve does not send the coolant through the radiator but through the bypass.

An object of the present invention is to prevent overheating of the engine when filling the radiator with coolant with the filling opening open and with the engine simultaneously warming up in idle, and simultaneously to shorten filling time.

This object has been achieved in accordance with the present invention by a cooling device in which the temperature-controlled thermostatic valve is controlled by electrical heating, and the electrical heating can be activated by actuating a switch mounted on the filling opening.

Electrical heating of the thermostatic valve simulates a high coolant temperature, so that the thermostatic valve does not conduct the coolant through the bypass between the supply and return lines, as usually happens when warming up the engine, but sends it instead at least partially, but preferably completely, through the radiator. The electrical switch is switchable either for the entire filling process or deliberately by manual actuation as required.

The cooling device according to the present invention also permits rapid filling of the radiator with coolant, because the deliberate opening of the thermostat to the radiator prevents the coolant from reaching the boiling point and simultaneously allows trapped air to escape more rapidly as a result of the improved coolant flow.

One advantageous embodiment of the present invention actuates the electrical switch on the filling opening by removing the cap on the filling opening. For example, the switch can be actuated by completely removing the cap from the filling opening or by, for example, moving the cap, pressing or pulling it in a way which differs from the usual rotary motion of the cap performed during the cap removal process.

With the improvement provided by the present invention, the thermostatic valve can either be heated automatically by removing the cap or can be heated deliberately for a specified period of time before removing the cap. This is an especially simple procedure for deliberately triggering the cooling of the coolant.

Another advantageous feature of the present invention is that actuation of the switch closes it, thus closing a circuit for electrically heating the thermostatic valve directly through this switch. This is a particularly simple and economical device to trigger deliberate heating of the thermostatic valve.

BRIEF DESCRIPTION OF THE DRAWINGS

These and other objects, features and advantages of the present invention will become more readily apparent from the following detailed description when taken in conjunction with the accompanying drawings wherein.

DETAILED DESCRIPTION OF THE DRAWINGS

Figure 1:
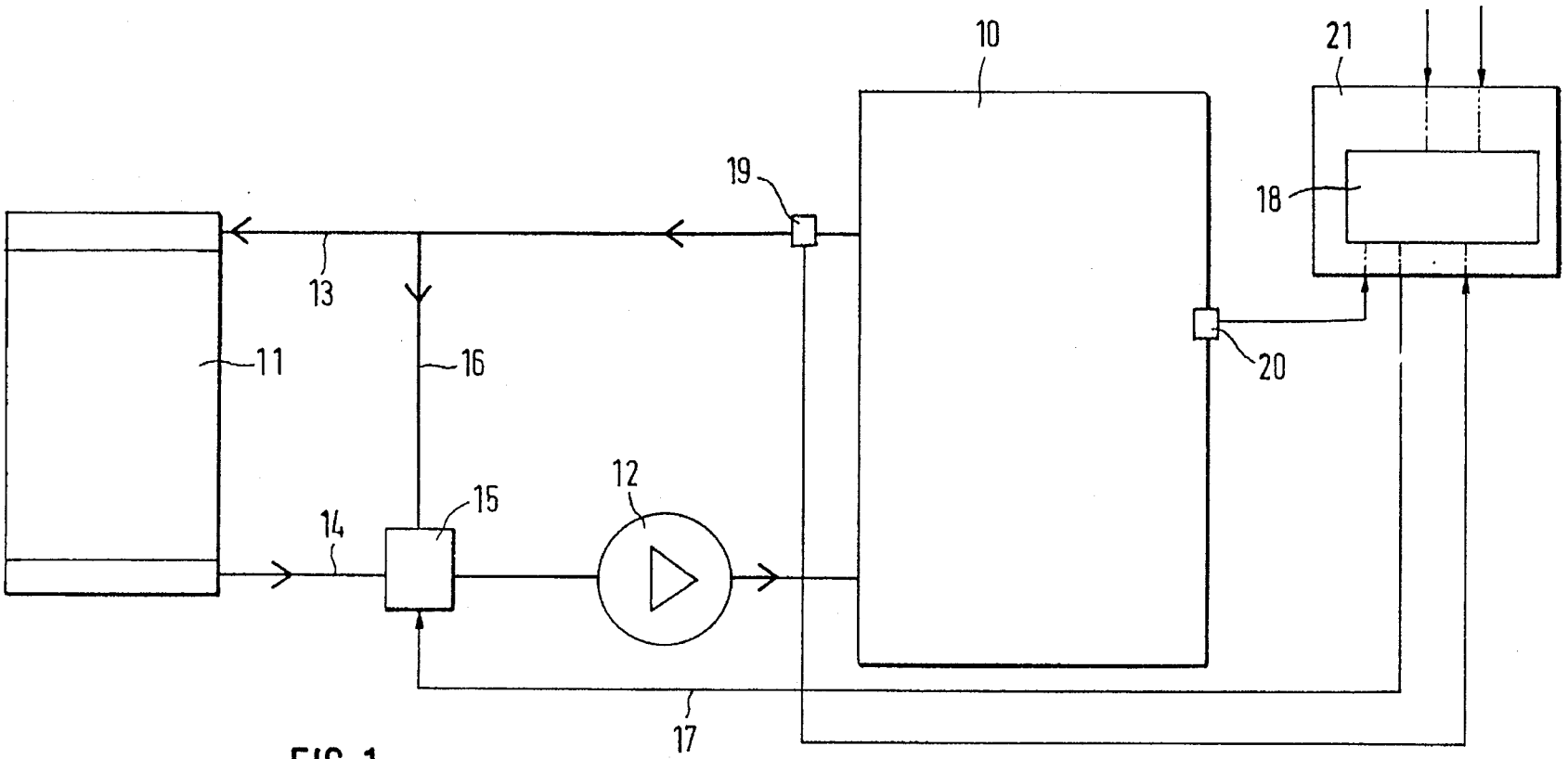
FIG. 1 PRIOR ART
FIG. 1 is a schematic depiction of a prior art cooling device to explain the function of the thermostatic valve of the present invention.

The cooling device for an engine 10 shown in FIG. 1 comprises a radiator 11. A coolant pump 12 is provided between the engine 10 and the radiator 11, to create a flow of coolant in the direction indicated by the arrows in heavy lines. A supply line 13 runs from the coolant outlet of the engine 10 to the coolant inlet of radiator 11. From the coolant outlet of radiator 11, a return line 14 runs to the coolant inlet of the engine 10. A conventional thermostatic valve 15, for example with an element made of expandable material (not shown), is located in the return line 14. A bypass line 16 branches off the supply line 13 to the thermostatic valve 15.

The cooling device essentially operates in three modes. In the first mode (the so-called warmup mode), especially after a cold start of the engine 10, the thermostatic valve 15 is set so that the flow of coolant coming from the engine 10 is returned essentially completely to the engine 10 through the bypass line 16. In the second mode, the cooling system operates in a mixed mode. That is, the coolant coming from the engine 10 runs partially through radiator 11 and partially through the bypass line 16 back to the engine 10. In the third mode, the cooling system operates in the radiator mode, i.e. the coolant coming from the engine 10 is returned essentially completely through the radiator 10 to the engine 10.

The operating mode of the cooling device can be adjusted by heating the thermostatic valve 15. For example, a known expandable material element constituting part of the valve 15 can be heated using an electrical lead 17 to induce radiator operation or to switch completely to radiator operation. Thus, the temperature of the coolant falls relative to the temperature reached in an operating mode without heating the thermostatic valve 15. The thermostatic valve 15 is supplied with electrical energy through the lead 17 by, for example, a control device 18 which receives and evaluates a plurality of signals representative of operating parameters. A temperature sensor 19 is commonly located at the coolant outlet of the engine 10. The sensor 19 determines the actual temperature of the coolant and transmits this data to the control device 18. A temperature sensor 20 can also be located in a header on the intake manifold of the engine 10 to determine the temperature of the intake air and to pass this data to the control unit 18. Preferably, the control device 18 is integrated into a known electronic engine control 21.

Therefore, the thermostatic valve 15 is usually electrically heated through the lead 17 which is connected with the output of control device 18, as a function of temperature values and other engine operating parameters. The electrically heating thermostatic valve 15 is utilized in the present invention to permit rapid filling of the radiator 11 by preventing overheating of the coolant and by improved coolant flow.

Figure 2:
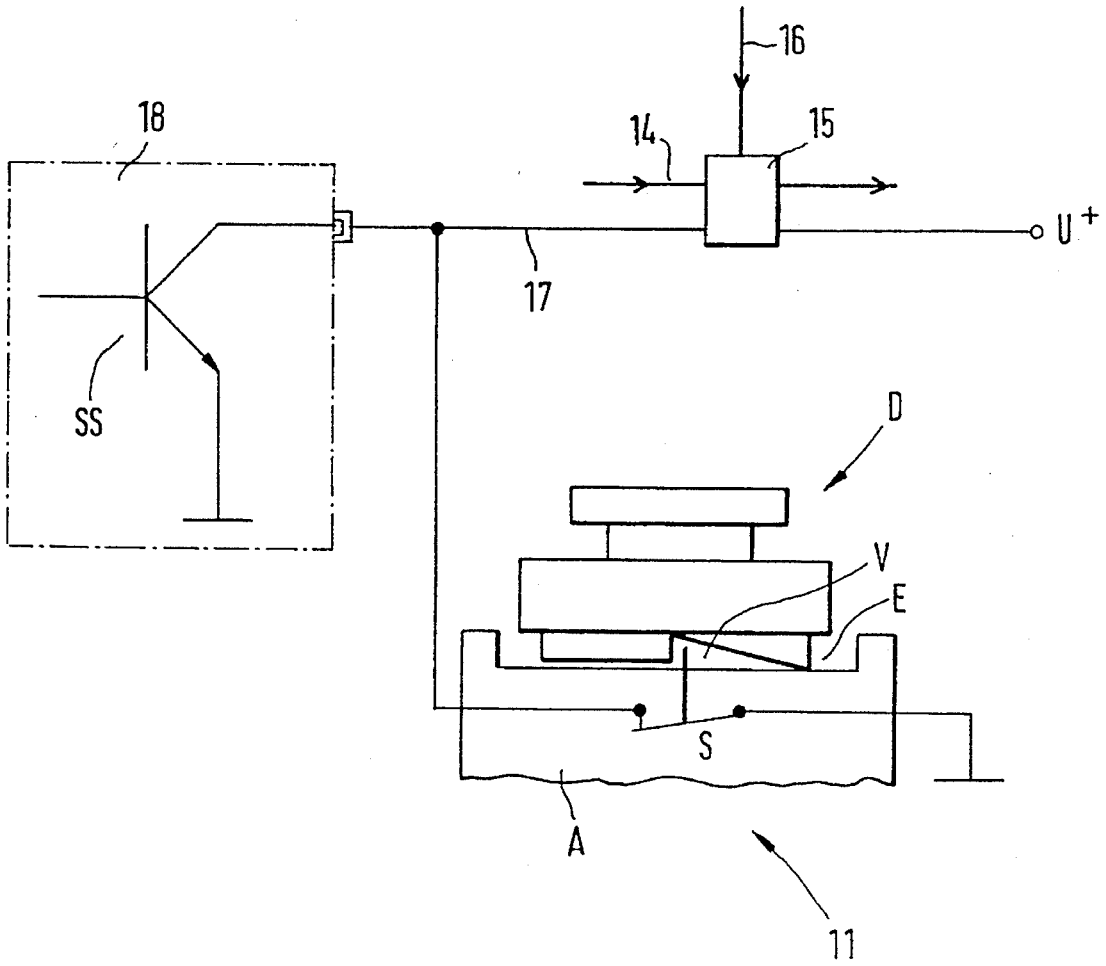
FIG. 2 is a schematic depiction of a cooling device according to the invention with a switch actuatable by the cap.

In FIG. 2 in which the elements that correspond constructionally and operationally to elements in FIG. 1 have been given the same reference numerals, the output of a controllable switch SS of the control device 18 is connected by the electrical lead 17 with the thermostatic valve 15, and the lead 17 is connected to a positive voltage $U^+$. The thermostatic valve 15 is connected in the known manner with the bypass line 16 and return line 14, and is likewise controlled by the electrical lead 17 in the manner shown in FIG. 1.

The electrical lead 17 is additionally connected with one pole of a two-pole switch S, and the other pole of the switch S is connected to ground. The electrical switch S is mounted on a filling opening E of an expansion chamber A of the radiator 11.

The electrical lead 17 is connected to ground when necessary by the control device 18 with the controllable switch SS. If the circuit between the positive voltage $U^+$ and the ground connection of the controllable switch SS is closed, the thermostatic valve 15 is heated, so that the operating mode of the cooling device shifts to the radiator operation.

According to the present invention, the circuit between the positive voltage $U^+$ and the ground can also be closed by the electrical switch S. When the cap D on the filling opening E is closed, the electrical switch S is opened. When the cap D is removed from the filling opening E, the electrical switch S is closed and, therefore, the thermostatic valve 15 is automatically heated.

It is also within the scope of the present invention, however to provide the cap D with a locking device V which locks the cap D in a predetermined position when it is opened, so that cap D cannot be turned further without having been pressed down in advance. With this embodiment, the electrical switch D is not permanently closed when the cap D is completely open, but only for as long as the cap D is pressed down. Thus, the venting process can be performed while filling the radiator 11 with coolant with the cap D closed, because opening of the cap D after previously pressing it down causes rapid cooling of the coolant and simultaneously prevents boiling coolant from spurting out. Thus, according to the present invention, not only can the radiator 11 be filled more rapidly but the safety of the individual performing the filling is also ensured.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A cooling device associated with a motor vehicle liquid-cooled internal combustion engine associated via supply and return lines, comprising a radiator having a filling opening closable by a cap, a temperature-controlled thermostatic valve operatively configured to send coolant completely or partially selectively through the radiator and a bypass between the supply and return lines to bypass the radiator, means for electrically heating the thermostatic valve, and an electrical switch mounted on the filling opening and operatively associated with the cap such that, with the cap removed from the filling opening, actuation of said electrical switch energizes the means for electrically heating the thermostatic valve independently of ambient temperature and the coolant is selectively circulated at least partially through the radiator.

2. The cooling device according to claim 1, wherein the electrical switch is configured to be actuatable by removing the cap from the filling opening.

3. A cooling device associated with a motor vehicle liquid-cooled internal combustion engine associated via supply and return lines, comprising a radiator having a filling opening closable by a cap secured by locking means, a temperature-controlled thermostatic valve operatively configured to send coolant completely or partially selectively through the radiator and a bypass between the supply and return lines to bypass the radiator, means for electrically heating the thermostatic valve, and an electrical switch mounted on the filling opening and operatively associated with the locking means such that when the cap is pressed down to unlock the locking means the electrical switch energizes the electrical heating means whereupon coolant is selectively circulated at least partially through the radiator.

* * * * *